US006911013B2

(12) United States Patent
Heimberger

(10) Patent No.: US 6,911,013 B2
(45) Date of Patent: Jun. 28, 2005

(54) METHOD AND APPARATUS FOR REGENERATING HAIR GROWTH

(76) Inventor: Hans Heimberger, 2040 Wiley Ridge Rd., Kankakee, IL (US) 60901

( * ) Notice: Subject to any disclaimer, the term of this patent is extended or adjusted under 35 U.S.C. 154(b) by 221 days.

(21) Appl. No.: 10/224,176

(22) Filed: Aug. 20, 2002

(65) Prior Publication Data

US 2004/0039314 A1 Feb. 26, 2004

(51) Int. Cl.[7] ..... A61H 15/00

(52) U.S. Cl. ..... 601/103; 601/97; 601/101; 601/112

(58) Field of Search ..... 601/46, 56, 57, 601/58, 70, 71, 79, 93, 95, 97, 112, 134, 136, 107, 108, 111, 101, 103; 128/898

(56) References Cited

U.S. PATENT DOCUMENTS

| | | | | | |
|---|---|---|---|---|---|
| 1,709,170 | A | * | 4/1929 | Hassler | 601/103 |
| 3,716,048 | A | * | 2/1973 | Alonso | 601/95 |
| 4,506,659 | A | * | 3/1985 | Chester | 601/97 |
| 4,920,957 | A | * | 5/1990 | Sutherland | 601/101 |
| 5,188,097 | A | * | 2/1993 | Hansen | 601/71 |
| 6,228,041 | B1 | * | 5/2001 | Ameer | 601/58 |

* cited by examiner

*Primary Examiner*—Michael A. Brown
*Assistant Examiner*—Quang D. Thanh
(74) *Attorney, Agent, or Firm*—Wood, Phillips, Katz, Clark & Mortimer

(57) ABSTRACT

A method of regenerating hair growth, including the steps of engaging a scalp area with an edge of a flexible member, reciprocating a portion of the flexible member through a stroke length along an axis of at least ½ inch at a rate of at least 1,500 strokes per minute, with the flexible member portion being spaced from the scalp area and the axis being oriented in a direction parallel to tangential to the engaged scalp area, and repeating the engaging and reciprocating steps until hair regeneration begins. An apparatus usable in such a method includes a handle, a drive secured to the handle and reciprocating along an axis relative to the handle, and a flexible massage member secured to the reciprocating drive. The massage member has an axial portion aligned with the axis, and a silicone massage portion extending laterally from the axial portion to a scalp engaging surface, with the massage portion being substantially flexible in the axial direction. The flexible massage member extends a lateral distance X and an axial distance Y, where X>Y, with the axial distance tapering down from a maximum axial distance at the axial portion to a minimum axial distance at the scalp engaging surface.

9 Claims, 2 Drawing Sheets

METHOD AND APPARATUS FOR REGENERATING HAIR GROWTH

BACKGROUND OF THE INVENTION

The present invention relates to hair growth, and more particularly to a method and apparatus for promoting regeneration of hair growth.

Alopecia (i.e., balding and thinning of hair, especially on the scalp) is common among many people for a variety of known (e.g., heredity) and unknown and/or unrecognized reasons. For their appearance and/or a variety of other reasons, some people who are balding or have thinning hair on all or parts of their scalp would rather have hair on those areas. As a result, a variety of treatments have been tried to stop the loss of hair, and preferably to regenerate new hair growth where hair has been lost.

For example, Upjohn Company of Kalamazoo, Mich., USA, has obtained wide success with the topical dermatological for treatment of alopecia which it sells under its ROGAINE® trademark. However, even as successful as that treatment has been, there are still many, many people on whom the treatment does not work or does not work satisfactorily (e.g., the texture of the regenerated hair may be unsatisfactory), or to whom the treatment is too expensive.

In short, the reality is that despite the long felt need for adequate treatment, there is still no adequate treatment form many people who have, but do not want to have, balding or thinning hair.

The present invention is directed toward overcoming one or more of the problems set forth above.

SUMMARY OF THE INVENTION

In one aspect of the present invention, an apparatus for regenerating hair growth is disclosed, including a handle, a drive secured to the handle and reciprocating along an axis relative to the handle, and a flexible massage member secured to the reciprocating drive. The massage member has an axial portion aligned with the axis, and a massage portion extending laterally from the axial portion to a scalp engaging surface, with the massage portion being substantially flexible in the axial direction.

In one form of this aspect of the invention, the drive reciprocates at a rate of at least 1,500 strokes per minute and in another form the drive reciprocates at a rate on the order of 2,700 strokes per minute.

In another form of this aspect of the invention, the massage portion is silicone.

In still another form, the drive reciprocates through a stroke length of at least ½ inch, and in still another form the drive reciprocates at a rate on the order of 2,700 strokes per minute.

In yet another form of this aspect of the invention, the flexible massage member extends a lateral distance X and an axial distance Y, where X>Y, and in another form the axial dimension of the flexible massage portion tapers from a maximum adjacent the axial portion to a minimum at the scalp engaging surface.

In another aspect of the present invention, a method of regenerating hair growth is disclosed, including the steps of massaging a scalp area with the above described apparatus, moving the apparatus to move the scalp engaging surface over a portion of the scalp area, and repeating the massaging and moving steps until hair regeneration begins. In the massaging step, the handle is held so that the scalp engaging surface of the flexible massage portion engages a portion of the scalp area with the axial reciprocation of the drive being in a direction generally parallel to tangential to the scalp area portion.

In one form of this aspect of the invention, the massaging and moving steps are repeated daily for at least thirty days and, in another form, the massaging and moving steps are performed at least fifteen minutes each day. In still another form, the massaging and moving steps are performed at least one minute on at least one day prior to the thirty day, fifteen minute repetitions of the massaging and moving steps.

In still another aspect of the present invention, an apparatus for regenerating hair growth is disclosed, including a reciprocating drive operating at a rate of at least 1,500 strokes per minute with a stroke length of at least ½ inch along an axis, and a massage portion extending laterally from the axis to a scalp engaging surface, the massage portion being substantially flexible in the direction of the axis.

In one form of this aspect of the invention, the drive reciprocates at a rate on the order of 2,700 strokes per minute. In still other forms, the massage portion is silicone, the flexible massage member extends a lateral distance X and an axial distance Y, where X>Y, and/or the axial dimension of the flexible massage portion tapers from a maximum adjacent the axis to a minimum at the scalp engaging surface.

In yet another aspect of the present invention, a method of regenerating hair growth is disclosed, including the steps of massaging a scalp area with the immediately above described apparatus by holding the apparatus so that the scalp engaging surface engages a portion of the scalp area with the axial reciprocation of the drive being in a direction generally tangential to the scalp area portion, moving the apparatus to move the scalp engaging surface over the portion of the scalp area, and repeating the massaging and moving steps until hair regeneration begins.

Yet another aspect of the present invention comprises a method of regenerating hair growth, including the steps of engaging a scalp area with an edge of a flexible member, reciprocating a portion of the flexible member through a stroke length along an axis of at least ½ inch at a rate of at least 1,500 strokes per minute, with the flexible member portion being spaced from the scalp area and the axis being oriented in a direction parallel to tangential to the engaged scalp area, and repeating the engaging and reciprocating steps until hair regeneration begins.

DESCRIPTION OF THE PREFERRED EMBODIMENTS

Figure 1:
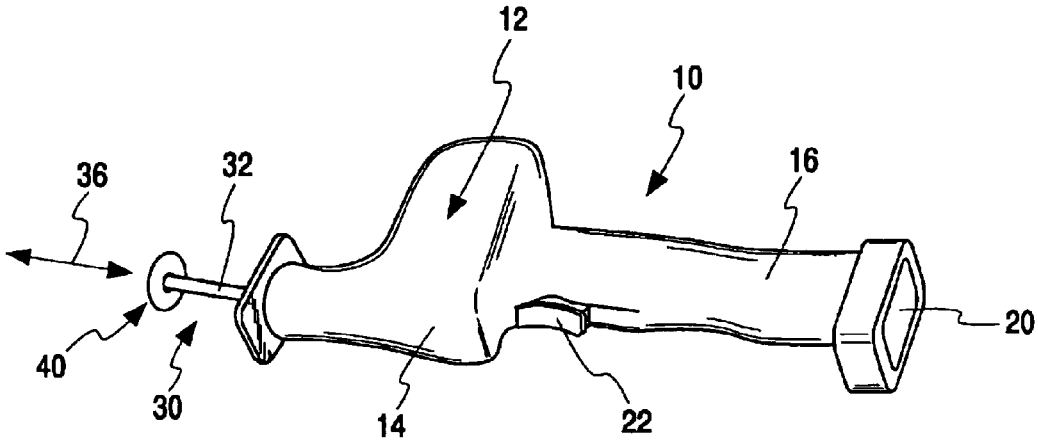
FIG. 1 is a perspective view of an apparatus usable to regenerate hair growth according to the present invention.

One apparatus 10 usable in regenerating hair growth is disclosed in FIG. 1, including a reciprocating drive 12 in a housing 14 defining a handle portion 16. A suitable power source 20 is also provided, illustrated as a battery in FIG. 1. Of course, other power sources suitable for the drive 12 could be used, including an electric cord which may be plugged into an outlet. However, a battery provides the convenience of being usable in virtually any location. A suitable power control 22 for the drive 12 is also provided, such as the illustrated trigger 22 conveniently located on the handle portion 16.

In accordance with the present invention, the reciprocating drive 12 should reciprocate at a relatively high rate through a relatively long stroke length so as to do more than merely vibrate the scalp when used such as described below. Specifically, a stroke length of ½ inch or greater at a rate of 1500 stokes per minute or more will stretch and invigorate the scalp in a manner which should regenerate hair growth in the scalps of some people. For example, a reciprocation rate on the order of 2700 strokes per minute with a 15 mm (9/16") stroke length has been found to regenerate hair growth in bald scalp areas.

A massage member 30 is suitably secured to the drive 12 and includes a mounting shaft 32 which, when secured to the drive 12, is generally axially aligned with the axis of reciprocation 36 of the drive 12. A massage portion 40 is secured to the mounting shaft 32, and includes a substantially flexible body which extends laterally (radially) from the mounting shaft 32 to an outer edge 42 adapted to engage the scalp where hair regeneration is desired.

Figure 4:
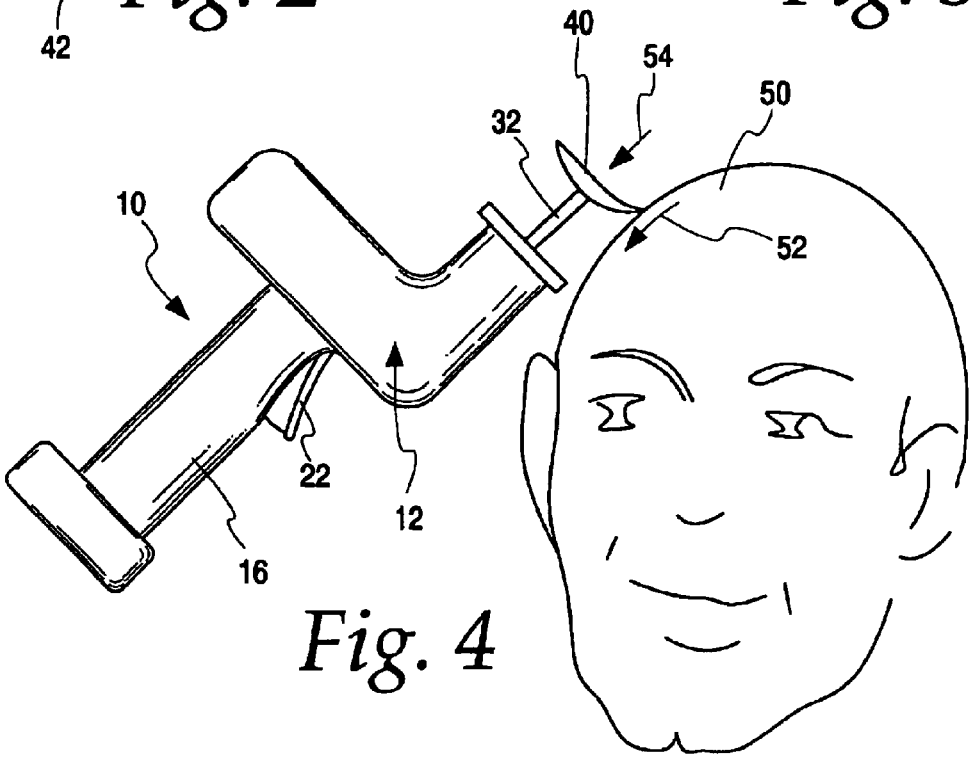
FIG. 4 is a partial view of the apparatus of FIG. 1 in use to regenerate hair growth.

The massage portion 40 may be made of a suitable material which will allow substantial flexibility in the axial direction so that, when contacting a scalp in use, it will not merely rub over the scalp, but will bend as shown at 46 in FIG. 4 so as to push and pull the scalp as it reciprocates in use. Silicone have been found to be a suitable material for the massage portion 40 such as, for example, gasket sealer made of high temp RTV silicone. However, still other materials could be used within the scope of the invention where the flexibility such as described herein is provided. The massage portion 40 may also extending radially from the shaft 32 a distance greater than the massage portion 40 extends axially to ensure suitable flexibility of the massage portion 40.

Figure 2:
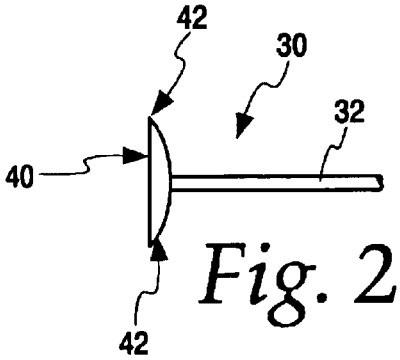
FIG. 2 is a plan view of one attachment usable with the apparatus of FIG. 1.
Figure 3:
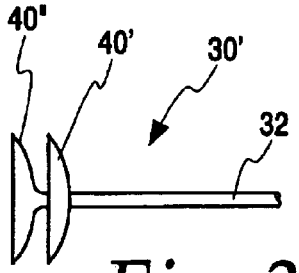
FIG. 3 is a plan view of an alternate attachment usable with the apparatus of FIG. 1.

An alternate massage member 30' usable with the apparatus 10 of FIG. 1 is illustrated in FIG. 3. The alternate member 30' includes a pair of axially spaced massage portions 40', 40", each of which may be similar to the massage portion 40 shown in FIGS. 1–2. Of course, still other configurations of flexible massage members could be used within the scope of the present invention as disclosed herein.

In use, the apparatus 10 is held by the user so that the axis of reciprocation 36 is generally tangential (parallel to tangential) to the portion of the scalp being engaged by the outer edge 42 of the massage portion 40. Therefore, as shown in FIG. 4, when the drive 12 strokes to reciprocate into the apparatus 10, the massage member 12 is moved with it so as to push or pull the massage portion 40 and also push or pull the scalp 50 of the user. Arrows 52 illustrates this action in one stroke direction (shown by arrow 54) of the drive 12. Also, the flexible body of the massage portion 40 will bend, whereby the scalp 50 will be pulled in quickly changing directions rather than being severely rubbed (and irritated) by the outer edge 42 such as would occur without such flexibility.

It should now be understood that the combination of the flexibility of the massage portion 40 and the reciprocation rate of the drive 12 should be sufficient to sufficiently invigorate the scalp by stretching it back and forth without hurting the skin. The outer edge 42 of the massage portion 40 may still be slid over the scalp to a degree, as when the user moves the apparatus to massage different areas of the scalp, but still the flexibility of the massage portion 40 will prevent damaging the scalp.

Use of the apparatus 10, in which the user moves the apparatus around his scalp 50 with the massage portion 40 engaging and moving over the scalp 50 with the drive 12 operating, should preferably be repeated daily for a selected period. For example, hair regeneration has been found to begin after using the apparatus 10 for a period of about 15 minutes each day for 30 days. A user may also work up to such a rate in order to prepare his scalp for such invigoration, such as by using the apparatus 10 for only a minute a first day, then a greater amount less than 15 minutes (e.g., 10 minutes) a next day, before beginning the 15 minute daily routine.

Figure 5:
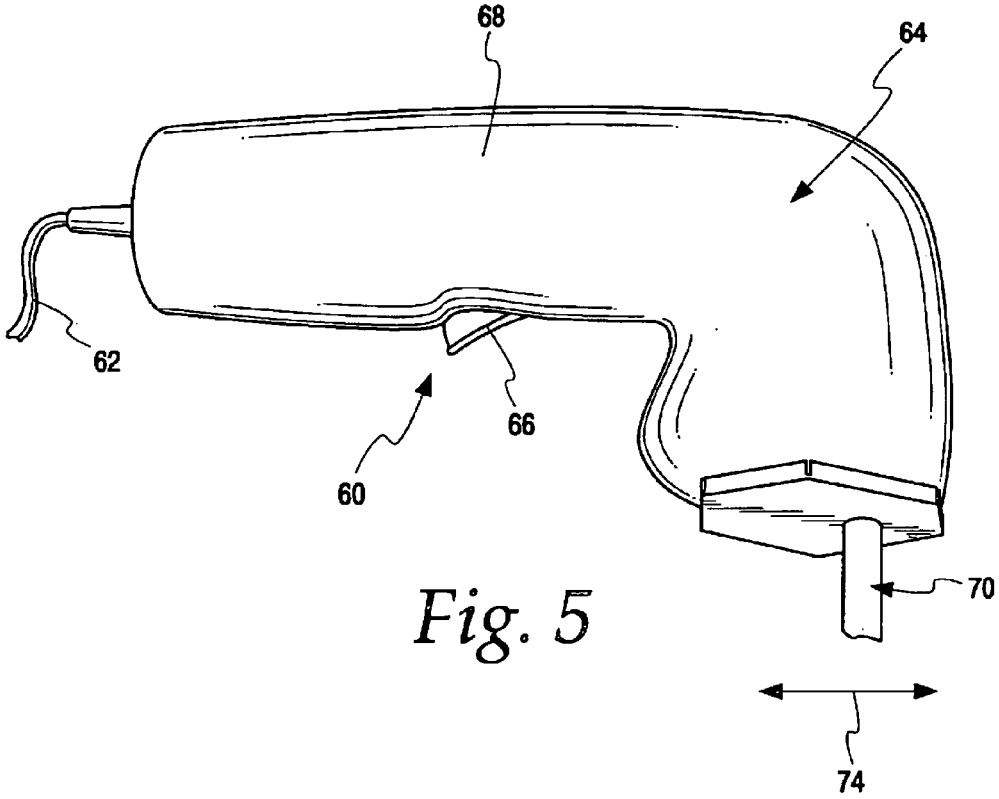
FIG. 5 is a plan view of an alternative embodiment of an apparatus usable to regenerate hair growth according to the present invention.
Figure 6:
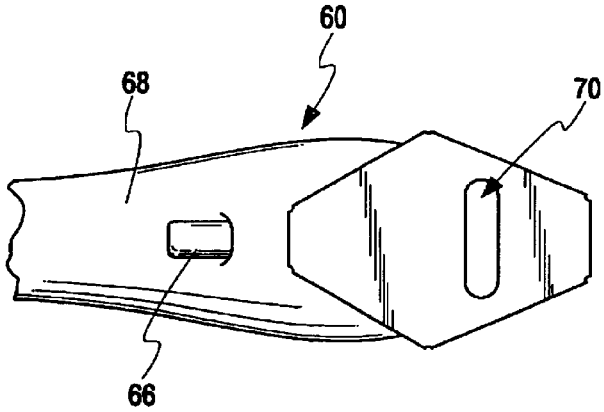
FIG. 6 is a partial front view of the apparatus of FIG. 5.

FIGS. 5–6 show an alternate embodiment of the present invention, in which the apparatus 60 includes an electric cord 62 for supplying power to the drive 64, with a suitable manually operable power control 66 (again, illustrated as a trigger which may be easily manipulated by a user grasping the handle portion 68 of the apparatus 60. In this alternate embodiment, the massage member 70 extends a single direction from its connection to the drive 64, with the drive 64 reciprocating the massage member 70 back and forth in the direction of the arrow 72.

It should now be appreciated that use of an apparatus such as disclosed herein will advantageously allow many people to regenerate hair rather than accept bald areas where they do not want to. Further, this can be easily and conveniently accomplished anywhere, including in the privacy of their home, at very little cost and effort.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

I claim:

1. A method of regenerating hair growth, comprising the steps of:

massaging a scalp area with an apparatus having a handle, a drive secured to said handle and reciprocating along an axis relative to said handle, and a flexible massage member secured to said reciprocating drive, said massage member having an axial portion aligned with said axis, and a massage portion extending laterally from said axial portion to a scalp engaging surface, said massage portion being substantially flexible the direction of said axis said massage is accompolished by holding said handle whereby said scalp engaging surface of said flexible massage portion engages a portion of said scalp area with said axial reciprocation of said drive being in a direction generally parallel to tangential to said scalp area portion;

moving said apparatus to move said scalp engaging surface over said portion of said scalp area;

repeating said massaging and moving steps until hair regeneration begins.

2. The method of claim 1, wherein said repeating step comprises repeating said massaging and moving steps daily for at least thirty days.

3. The method of claim 2, wherein said massaging and moving steps are performed at least fifteen minutes each day.

4. The method of claim 3, further comprising performing said massaging and moving steps at least one minute on at least one day prior to repeating said massaging and moving steps for said at least fifteen minutes each day for said at least thirty days.

5. A method of regenerating hair growth, comprising the steps of:

massaging a scalp area with an apparatus having a reciprocating drive operating at a rate of at least 1,500 strokes per minute with a stroke length of at least ½ inch along an axis, and a massage portion extending laterally from said axis to a scalp engaging surface, said massage portion being substantially flexible in the direction of said axis, said massaging is accomplished by holding said apparatus whereby said scalp engaging surface engages a portion of said scalp area with said axial reciprocation of said drive being in a direction generally tangential to said scalp area portion;

moving said apparatus to move said scalp engaging surface over said portion of said scalp area;

repeating said massaging and moving steps until hair regeneration begins.

6. A method of regenerating hair growth, comprising the steps of:

engaging a scalp area with an edge of a flexible member;

reciprocating a portion of said flexible member through a stroke length along an axis of at least ½ inch at a rate of at least 1,500 strokes per minute, said flexible member portion being spaced from said scalp area and said axis being oriented in a direction parallel to tangential to said engaged scalp area;

repeating said engaging and reciprocating steps until hair regeneration begins.

7. The method of claim 6, wherein said repeating step comprises repeating said engaging and reciprocating steps daily for at least thirty days.

8. The method of claim 7, wherein said engaging and repeating steps are performed at least fifteen minutes each day.

9. The method of claim 8, further comprising performing said massaging and moving steps at least one minute on at least one day prior to repeating said massaging and moving steps for said at least fifteen minutes each day for said at least thirty days.

* * * * *

UNITED STATES PATENT AND TRADEMARK OFFICE

CERTIFICATE OF CORRECTION

PATENT NO. : 6,911,013 B2
DATED : June 28, 2005
INVENTOR(S) : Hans Heimberger

It is certified that error appears in the above-identified patent and that said Letters Patent is hereby corrected as shown below:

Column 4,
Line 53, after "flexible" insert -- in --; and
Line 55, delete "massage is accomplished" and insert -- massaging is accomplished --.

Signed and Sealed this

Sixth Day of December, 2005

JON W. DUDAS
*Director of the United States Patent and Trademark Office*